United States Patent [19]

Lagsdin

[11] Patent Number: 4,889,362

[45] Date of Patent: Dec. 26, 1989

[54] STABILIZER PAD FOR EARTHMOVING APPARATUS

[76] Inventor: Andry Lagsdin, 54 King Hill Rd., Hanover, Mass. 02339

[21] Appl. No.: 183,844

[22] Filed: Apr. 20, 1988

[51] Int. Cl.[4] ..... B60S 9/02

[52] U.S. Cl. ..... 280/763.1; 212/189; 280/764.1

[58] Field of Search ..... 280/764.1, 763.1; 212/189; 305/51, 55, 54

[56] References Cited

U.S. PATENT DOCUMENTS

| | | | |
|---|---|---|---|
| 3,219,362 | 11/1965 | Epstein | 280/763.1 |
| 3,495,727 | 2/1970 | Long | 212/189 |
| 3,642,242 | 2/1972 | Danekas | 280/763.1 |
| 3,721,458 | 3/1973 | Mitchell | 280/764.1 |
| 3,897,079 | 7/1975 | MacKenzie et al. | 280/764.1 |
| 3,913,942 | 10/1975 | MacKenzie et al. | 280/764.1 |
| 3,930,668 | 1/1976 | Schuermann et al. | 280/763.1 |
| 4,023,828 | 5/1977 | MacKenzie et al. | 280/763.1 |
| 4,039,206 | 8/1977 | Nault | 280/763.1 |
| 4,761,021 | 8/1988 | Lagsdin | 280/764.1 |

*Primary Examiner*—Charles A. Marmor
*Assistant Examiner*—Eric Culbreth
*Attorney, Agent, or Firm*—Wolf, Greenfield & Sacks

[57] ABSTRACT

Earth moving equipment especially of the loader/-backhoe type is provided with hydraulically operated stabilizer arms having associated therewith stabilizer pads. The pad is a reversible stabilizer pad having a flanged surface for engagement with gravel, for example, and a somewhat resilient surface for engagement with pavement, for example. The flanged surface has multipoint contact for improved stability. An automatically operable latch maintains the pad in a locked position but permits automatic latch disengagement for pad reversal. An adapter plate and pad assembly is used for pad replacement.

4 Claims, 6 Drawing Sheets

Fig. 6
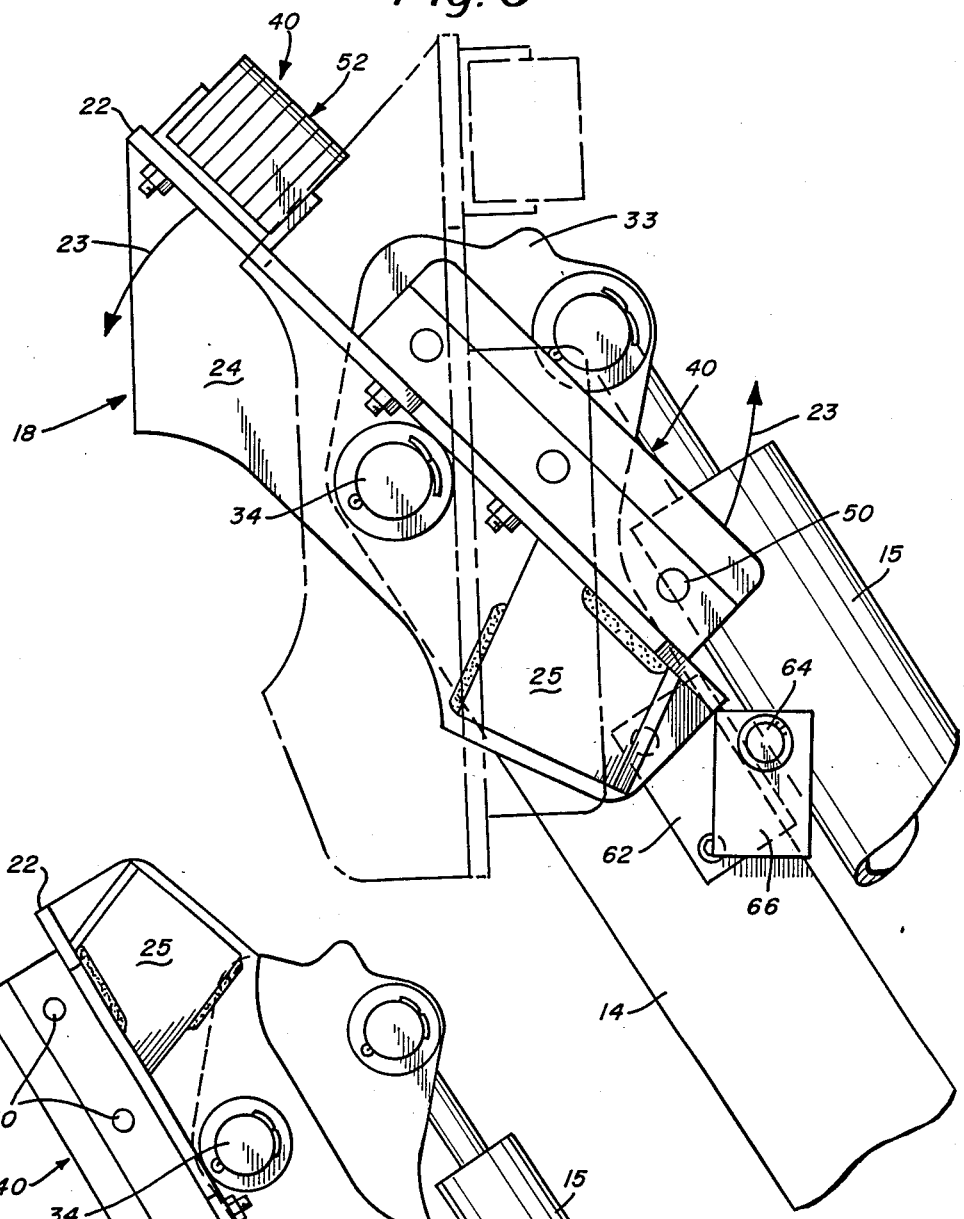
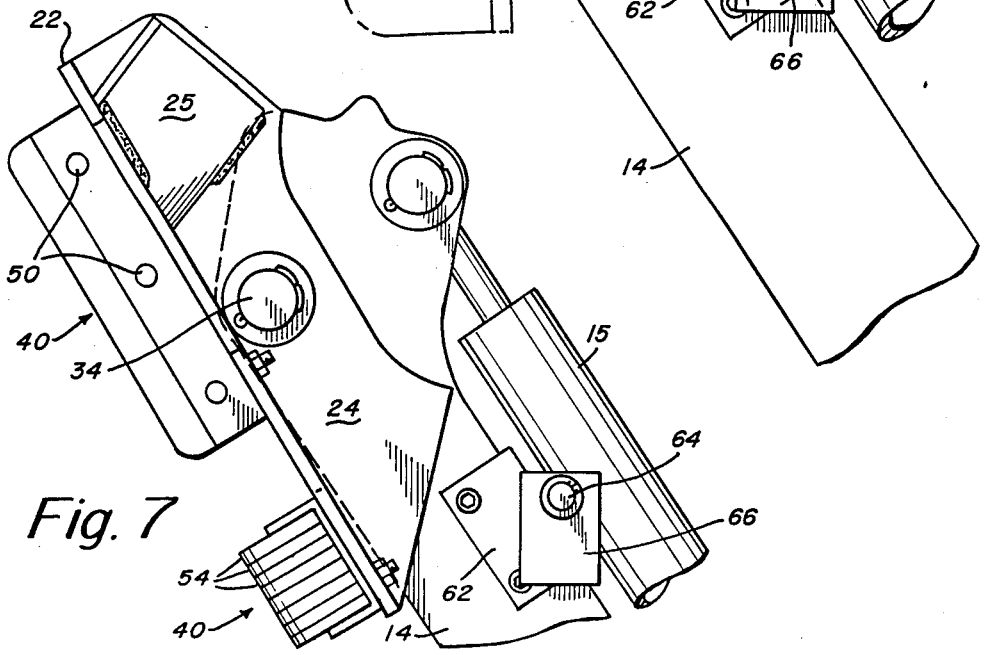
Fig. 7

STABILIZER PAD FOR EARTHMOVING APPARATUS

RELATED APPLICATION

The present invention relates to my co-pending application Ser. No 06/870,099, filed June 3, 1986 on a Stabilzer Pad For Earthmoving Apparatus.

BACKGROUND OF THE INVENTION

1. Field of the Invention

The present invention relates in general to a stabilizer pad for use with earthmoving apparatus. More particularly, the present invention is concerned with a stabilizer pad that is reversible so that it may be usable on either, for example, concrete or a more yielding surface such as dirt or gravel. Even more particularly the present invention relates to a reversible stabilizer pad of improved construction as to its stability when in use and its adaptability to different terrain conditions.

2. Background Discussion

Reference is now made herein to U.S. Pat. Nos. 3,897,079 and 3,913,942 both relating to stabilizer pads for earthmoving apparatus. These prior art patents, in which I am a co-inventor, illustrates a reversible stabilizer pad having a generally flanged surface for engagement with gravel, for example, and a somewhat resilient surface for engagement with concrete or asphalt, for example. U.S. Pat. No. 3,897,079, for example describes the use of rubber pads or stops 38 on one side of the stabilizer member such as illustrated in FIG. 2 of this patent.

In the past these pads have been constructed of a molded rubber and although operation therewith has been satisfactory, for some applications the service life of the molded pad is too short particularly when these pads are used on larger machines. The molded rubber pad can be destroyed particularly if the surface upon which the pad is used is somewhat abrasive. It was common for a small tear to develop in the molded rubber pad and after use thereof the pad might come apart in chunks. In this connection, my copending application Ser. No. 06/870,099 filed June 3, 1986 describes an improved reversible stabilizer pad for use with earthmoving apparatus and one that in particular employs a laminated pad.

In these prior stabilizer pad constructions, such as the one described in U.S. Pat. No. 3,897,079, the stabilizer pad generally includes a flat plate having triangular flanges extending from one surface thereof with each flange basically providing single point contact at grouser point with the earth. With such an arrangement earth simply diverges away for the single initial contact point, thus providing one grouser embedded in the terrain. In this arrangement there has tended, to be a rocking motion associated with the pad. Further, there is also a tendency for the pad to self-flip, particularly should the earthmoving machine pad support arm be lifted. The self-flipping of the pad can be remedied with the use of a securing or engagement pin or bolt that is required to be secured in each position of the pad and to be disassembled and re-secured when the position of the pad is to be changed. This becomes time consuming and furthermore may involve parts that are easily lost. The operator may also simply not bother to use the securing pin or bolt.

Accordingly, it is an object of the present invention to provide an improved reversible stabilizer pad for use with earthmoving apparatus and in which the pad has an improved ground-engaging flange means providing at least two point contact at two grouser points per flange for providing improved pad stability when used with a yielding surface such as dirt or gravel.

Another object of the present invention is to provide an improved reversible stabilizer pad for use with earthmoving apparatus and which is provided with an automatically operable securing latch that prevents pad self-flipping A further object of the present invention is to provide an improved reversible stabilizer pad for use with earthmoving apparatus and in which the pad construction is adapted to provide greater pad stability without any substantial rocking of the pad.

Still another object of the present invention is to provide an improved reversible stabilizer pad for use with earthmoving apparatus and in which there is, in particular, provided an improved pad and support adapter plate that enables ready resilient pad replacement.

SUMMARY OF THE INVENTION

To accomplish the foregoing and other objects features and advantages of the invention, there is provided an improved reversible stabilizer pad for use with earthmoving apparatus or other related applications. The stabilizer pad is comprised of a plate-like piece having alternate surfaces, one of which is relatively resilient and the other of which includes a flanged web, and typically a pair of spaced flanged webs for engagement with a terrain such as one of dirt or gravel. Means are provided for pivotally supporting the pad to an end the support arm of the earthmoving apparatus. The pad is rotatable relative to the earthmoving apparatus support arm between alternate positions wherein either the resilient surface is facing downwardly or the flanged web surface is engaging the ground.

In accordance with one feature of the present invention the flanged web, instead of being of generally triangular shape, providing single point contact at a single grouser point, is more of trapezoidal-type shape providing two point contact via two grouser point per flange. When employing the preferred pair of flanged webs then this essentially provides four point contact with the ground. Moreover, the two point contact of the flanged web is arranged to be symmetrical relative to the pivot axis of the pad.

In accordance with a further feature of the present invention, there is provided, associated with the pad, an automatically operable latch that is adapted to rotate into an engagement position with the pad when the pad is in a ground engaging surface, and furthermore adapted to automatically rotate by gravitational force out of engagement with the pad when the arm of the earthmoving machine that supports the pad is lifted. In this way when the support arm is lifted the latch disengages from the pad and the pad is easily rotated to its opposite position. This is all accomplished without any operator intervention. The latch simply operates by pivotal and gravitational forces to either engage or disengage from the pad depending upon the position of the support arm.

In accordance with a further feature of the present invention there is provided an improved pad and support and adaptor plate construction that is used for the purpose of replacement of the resilient pads that comprise part of the reversible pad construction. The old used resilient pads are removed and an adapted plate with new resilient, preferably laminated, pads is secured to the existing plate piece of the pad construction. Securing bolts or the like are disposed on the adapter plate in a pattern matching the holes in the plate piece.

BRIEF DESCRIPTION OF THE DRAWINGS

Numerous other objects, features and advantages of the invention should now become apparent upon a reading of the following detailed description taken in conjunction with the accompanying drawings, in which:

FIG. 6 is a fragmentary side elevation view showing the pad support arm in its lifted position with the latch now positioned to permit rotation of the pad and furthermore illustrating, in phantom outline, the normal, at rest, position of the stabilizer pad;

FIG. 7 is a fragmentary side elevation view showing the latch disengaged and illustrating the pad having been flipped to the opposite side such as would be a position for engagement of a firm surface such as the street or pavement;

DETAILED DESCRIPTION

Figure 1:
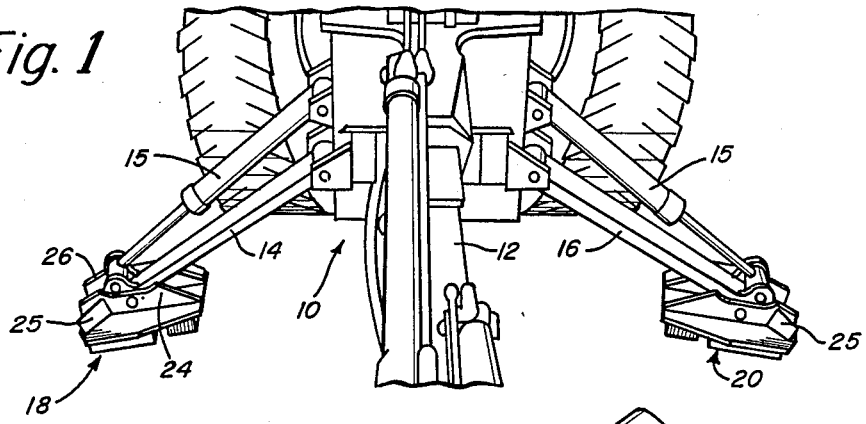
FIG. 1 is a fragmentary view of a typical loader/-backhoe having the stabilizer pads of the present invention secured thereto.

FIG. 1 is a fragmentary view of a typical loader/-backhoe 10 having a shovel mechanism 12, stabilizer arms 14 and 16, and associated stabilizer pads 18 and 20, respectively. A hydraulic piston 15 may operate each of the stabilizers 14 and 16 independently. When the equipment is being moved the pistons associated with each cylinder are withdrawn so that the support arms pivot and are thus elevated above ground level. As the arms are pivoted upwardly, it is in that position that the pads may then be reversed. When the support arms are to be used, the pistons associated with each of the cylinders are extended to the position as substantially shown in FIG. 1 for ground engagement.

Figure 2:
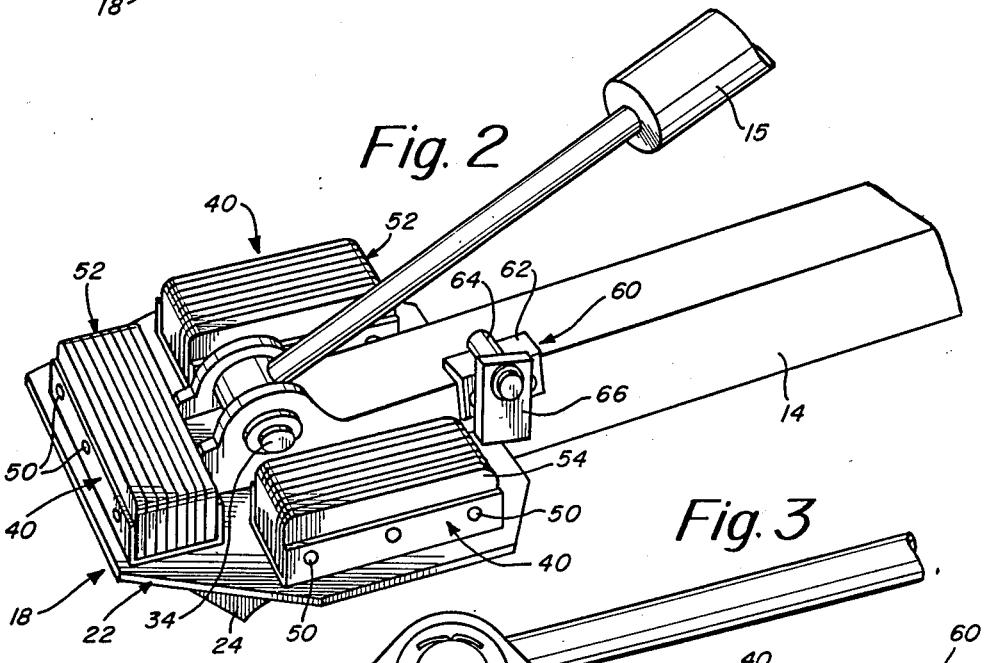
FIG. 2 is a perspective view of one of the stabilizer pads of FIG. 1 in a gravel or dirt engaging position.
Figure 3:
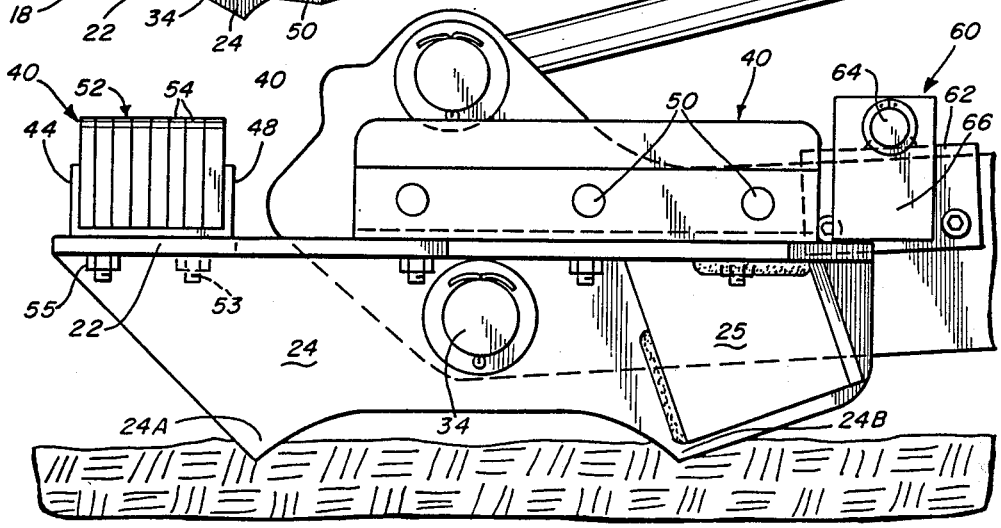
FIG. 3 is a side elevation view of the stabilizer pad construction in the position of FIG. 2.

With reference to FIGS. 2 and 3, the stabilizer pad 18 generally includes a flat plate 22 that has extending normal to the surface thereof the flanges 24 and 26, both extending on one side from the surface of plate 22. The stabilizer pad is also provided with supporting webs or ribs 25, one associated with each flange. These provide additional support for the flanges 24 and 26.

Figure 8:
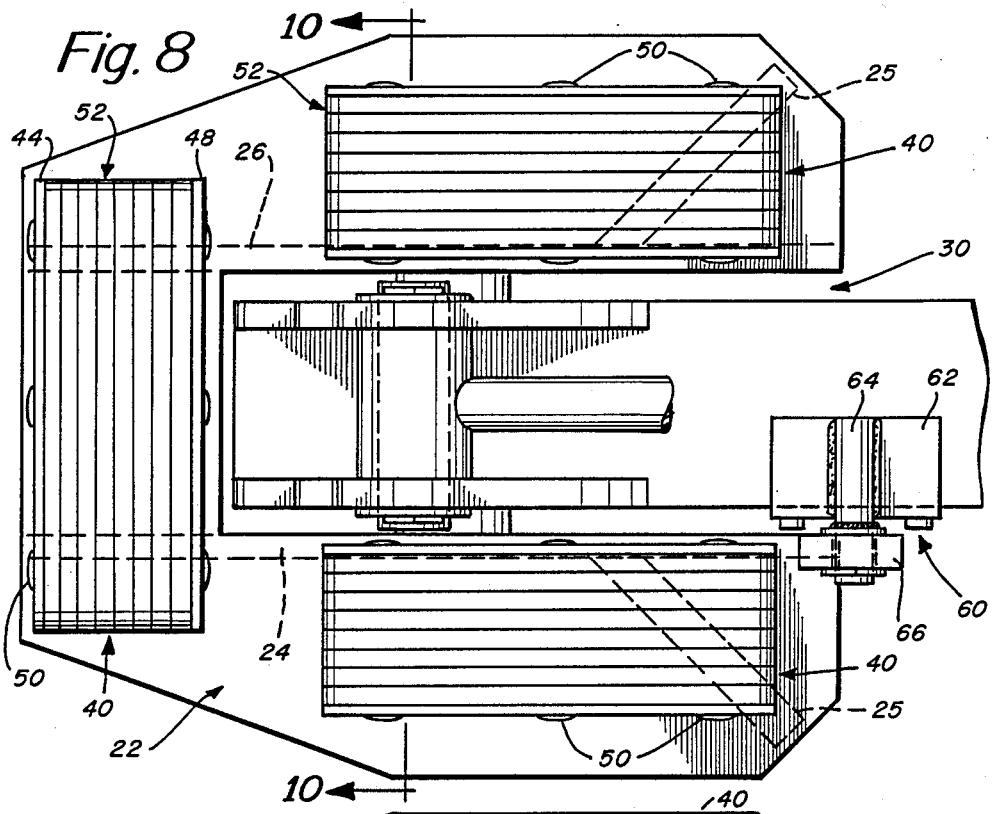
FIG. 8 is a top plan view of the pad on the machine when in a ground or gravel engaging position.
Figure 9:
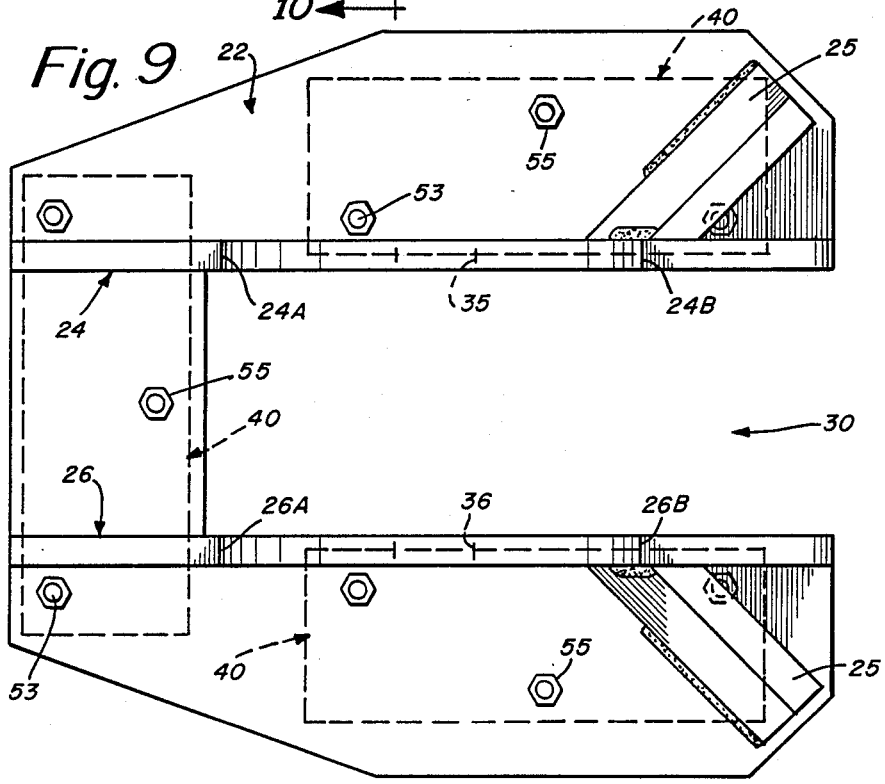
FIG. 9 is a bottom plan view of the pad off the machine.
Figure 10:
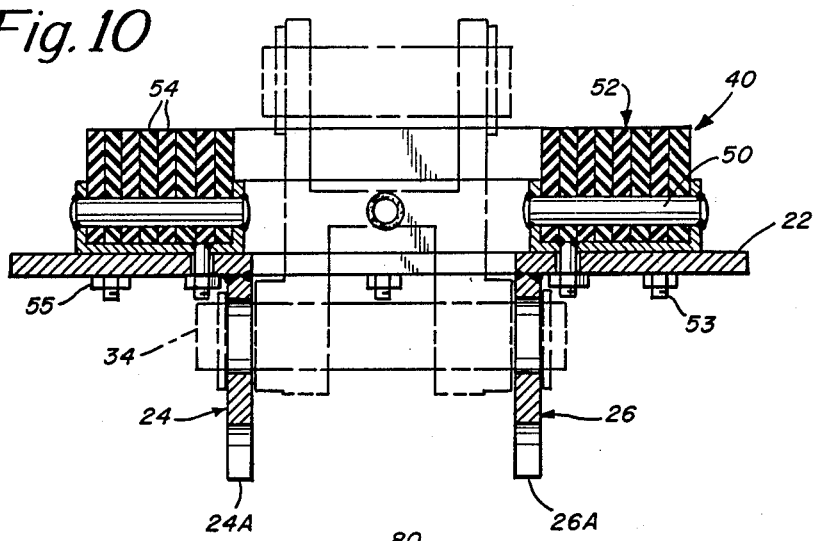
FIG. 10 is a cross-sectional view taken along line 10—10 of FIG. 8.

The plate 22 is notched at 30 between flanges 24 and 26 such as is illustrated in FIGS. 8 and 9 herein. The plate is notched so as to accommodate the arm 14 and to enable the reversible rotation of the stabilizer pad The arm 14 includes a journal end for accommodating pin 34. Pin 34 also fits within holes 35 and 36 of flanges 24 and 26, respectively, such as is illustrated in FIG. 9. The pin 34 may be secured in place by means of a typical cotter pin as illustrated in FIG. 3, or the pin 34 may be threaded to accommodate a nut.

FIGS. 2 and 3 also clearly illustrate the resilient side of the reversible stabilizer pad. The resilient side of the pad is in the form of three laminated pads 40. For further description of the resilient pad construction and its method of assembly, refer to my co pending application Ser. No. 06/870,099 filed June 3, 1986, now U.S. Pat. No. 4,761,021.

The drawings illustrate the basic components comprising the stabilizer member resilient pad structure. This includes the angle irons 44 and 48 as illustrated in FIG. 3. Both angle irons includes a base leg and an upright leg. Each of the upright legs has holes therein for receiving the elongated securing pins 50. In this regard refer to the pins 50 in FIG. 2.

FIGS. 2 and 3 illustrate the laminate structure 52 which generally comprises a plurality of separate pieces 54 shown arranged in a sandwich or laminate array. Each of the pieces may be pre-drilled with a hole to receive the corresponding pins 50.

Each of the pieces 54 is preferably made from sidewall segments of truck-tire carcasses. In this connection it is preferred not to use a steel belted tire for forming these simply because it is more difficult to cut a steel belted tire into such pieces. Each of the pieces 54 may have a thickness that is preferably on the order of ½ inch in its uncompressed state, and preferably in the range of ¼ to ¾ inch thickness. In a typical installation 8 to 10 pieces 54 may be employed in the laminate. Of course, for larger pads then the number of pieces would be increased.

It is preferred to use segments from a truck tire so that each of the individual pieces are of proper thickness to provide proper durability and stiffness. Typically, truck tires are of 10 ply or greater. It is preferred to use a multiple ply truck tire because this provides a relatively high ratio of cord to rubber relative thickness. The thickness of the cord that provides the primary stability is preferably 4 times that of the thickness of the rubber. The greater the ply number of the tire the greater the stability of the laminate.

The laminated pads are secured to the plate 22 by means of a series of bolts 53 each having associated nuts 55 such as illustrated in FIG. 3. Once again, in connection with the fabrication of the pads 40 refer to my co-pending application Ser. No. 06/870,099 filed June 3, 1986 now U.S. Pat. No. 4,761,021.

One feature in accordance with the present invention is the improved web construction. In the prior art, including patents identified hereinbefore, the flanged web has been of generally triangular shape with single point contact. However, now, in accordance with the present invention, such as in the illustration of FIG. 3, the web 24 has two contact points illustrated in FIG. 3 as grouser points 24A and 24B. The other flanged web 26 similarly has grouser points 26A and 26B. This is illustrate in FIG. 9. There are thus essentially a total of 4 contact points per pad providing substantially improved stability for the pad. This multipoint contact also prevents rocking of the pad which is a common problem with existing pad constructions. Moreover, the new grouser point web construction prevents self flipping of the pad. It is also noted in, for example, FIG. 3 that the grouser points 24A and 24B are disposed substantially symmetrically relative to the pivot as defined by pin 34. Essentially, one grouser point is disposed on either side of the pivot 34 for enhanced stability of the reversible pad construction.

Figure 4:
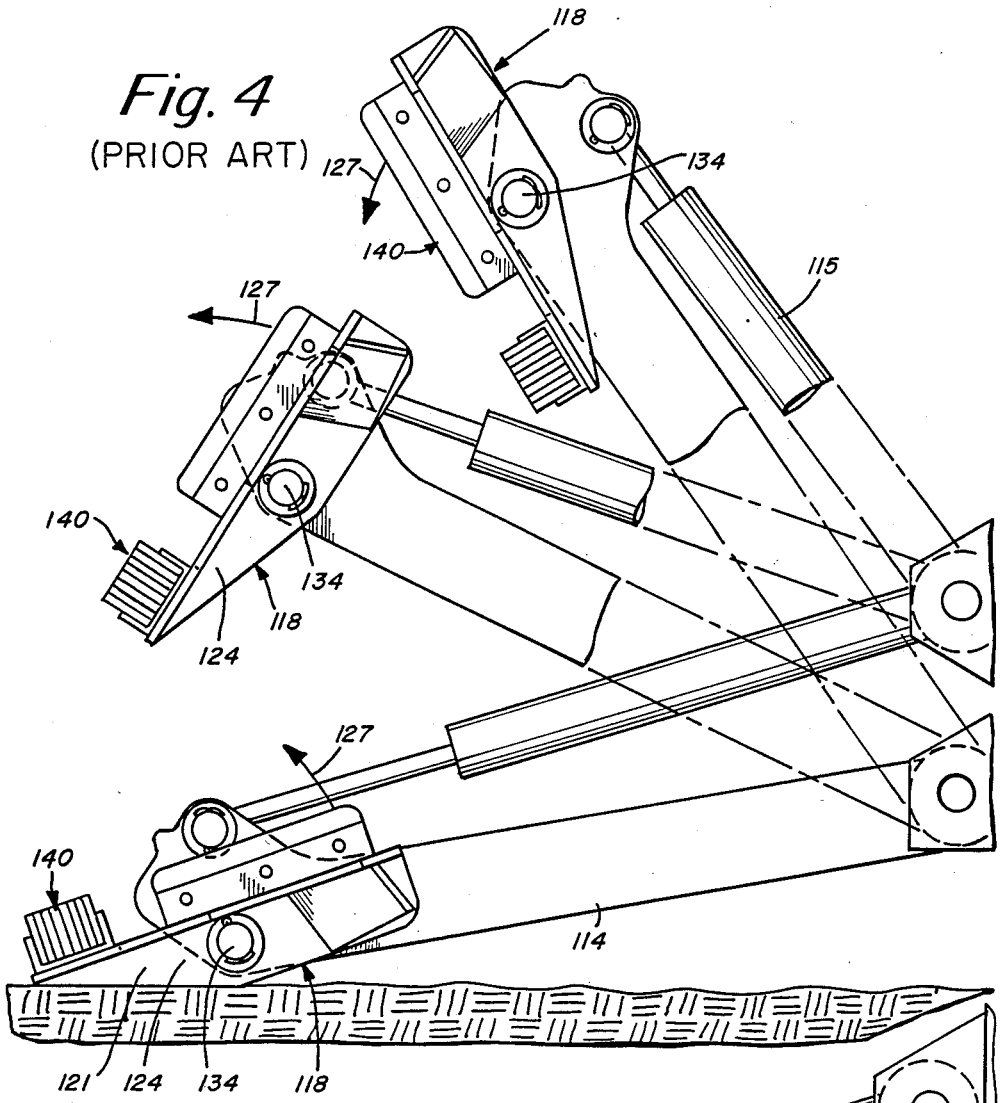
Fig. 4 (PRIOR ART)
FIG. 4 is a sequential diagram illustrating the prior art problem of pad self-flipping.
Figure 5:
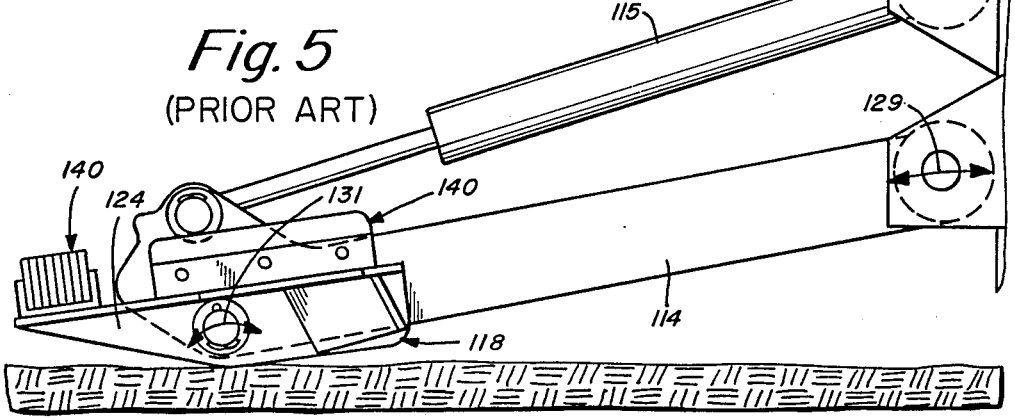
Fig. 5 (PRIOR ART)
FIG. 5 is a side elevation view illustrating the prior art rocking problem relative to the reversible pad construction.

To illustrate the problems of pad self-flipping and pad rocking, refer now to the prior art drawings of FIGS. 4 and 5. In FIGS. 4 and 5 the apparatus is comprised of the machine support arm 14 and associated piston 115. The pad 118 is supported at pivot pin 134 from the support arm 114. The drawing also illustrates the resilient pads 140 as well as the flanged web 124.

Now, in FIG. 4 there is an illustration of a sequence of events as the support arm 114 is lifted. In the bottom position the pad is illustrated with its flanged web in contact with the ground surface. In the top position it is noted that the pad has now self-flipped so that the resilient side of the pad is facing substantially downwardly. The support arm 114 may be lifted in a rather jerky motion. Because of certain inertia that the pad has and because of the single point grouser contact of the prior art, then the pad is apt to flip on its own, which is not desired. Although the pad does not tend to self flip from the rubber side to the grouser side, because the rubber side of the pad is considerably heavier than the grouser side, the pad does tend to self-flip from the grouser side to the rubber pad side. In this regard in, for example, FIG. 3 of the present application with the pivot being at 34, it is noted that there is considerably more weight on the pad side of the stabilizer than on the grouser side. The same also applies to FIGS. 4 and 5.

In the bottom sequence of FIG. 4, the pad is shown engaging the ground surface. In this connection there may be adhesion provided particularly at area 121 due to clods of dirt, etc. that may tend to hold the pad down and create an even more uneven force. As the arm 114 is raised then there is an inertia force in the direction of arrow 127 This same inertia force is also illustrated in the middle position illustrated in FIG. 4 wherein the pad is illustrated as now having been half-flipped upon a raising of the support arm 114. The top position in FIG. 4 illustrates the pad now completely reversed. When the arm 114 is now lowered the wrong surface will now be in engagement with the ground because the pad has now self-flipped.

FIG. 5 illustrates the manner in which the single point contact can lead to a rocking motion. Essentially because there are two flanged webs there are two points of contact but these are essentially along the same plane. In accordance with the present invention there is two point contact per web, thus essentially having two points of contact in two separate planes on either side of the pivot axis. FIG. 5 illustrates the rocking motion that can occur causing instability in the earthmoving apparatus as represented by the side-to-side motion of arrow 129. Arrow 131 also illustrate this pivotal, side-to-side, rocking motion of the stabilizer pad.

Reference is now made to a further feature of the present invention in the form of a latch illustrated, for example, in FIGS. 2 and 3 and also illustrated in alternate positions in FIGS. 6 and 7. The latch 60 include an angle iron plate 62 secured to the arm 14, a pivot shaft 64, and a freely pivotal latch member 66. The latch member 66 and its support shaft 64 are freely rotatable in the member 62 and rotate under gravitational force as the arm 14 is lifted. In this regard it is noted that the latch member 66 is pivoted off center so that gravitational force is applied to essentially rotate the latch member 66 relative to the support arm 14. Actually, the latch member 66 is maintained substantially always in a vertical position as the arm 14 is raised and thus there is only relative rotation between the latch member 66 and the arm 14.

In FIGS. 2 and 3 the latch member 66 is illustrated in engagement with the plate 22 of the stabilizer pad. In this position, even if the arm 14 is lifted partially, the latch member 66 stays in engagement with the stabilizer pad and prevents flipping thereof.

As the arm is lifted, such as to the position of FIG. 6, then the latch rotates, always maintaining its vertical position, but providing sufficient clearance so that the pad can then be pivoted to its opposite position when the arm is substantially fully raised. The arrangement of the present invention is such that one can essentially lock the pad in position without requiring the manual insertion of a pin or the like. When the arm is moved upwardly, the latch automatically disengages after substantial raising of the arm and the pad can be pivoted.

Now, reference is made to FIG. 6 illustrating a position in which the arm 14 has been lifted to a point where the latch member 66 is in a position relative to the arm 14 so that the pad clears the latch member 66 and can then be manually flipped. With the support arm raised, the latch is out of the way to allow the operator to flip the pad over If the pad is not to be flipped then the pad stays in the previous position and is automatically relocked (latched) when the arm is lowered.

It is noted in FIG. 6 that in phantom is illustrated the normal at rest position of the stabilizer pad with the arm up. In this regard, it is noted that there is provided a stop at 33 that contacts the pad, and in particular the resilient pad 40 to limit clockwise rotation of the resilient pad as viewed in FIG. 6.

FIG. 6 also illustrates by arrows 23 the direction of rotation of the pad about its pivot 34. FIG. 6 shows the pad clearing the latch member 66. FIG. 7 illustrates the pad now having been flipped to its opposite side with the resilient pad construction now for engagement with a pavement, also referred to as the street side of the pad. In this position, the arm 14 itself functions to limit the counterclockwise rotation of the reversible pad. In the particular embodiment disclosed herein, the latch does not operate or contact the pad in the street side position of the pad as indicated previously, the street side pad position of the stabilizer is the heavier side and thus there is no tendency toward self-flipping in this particular embodiment and thus in the disclosed embodiment the latch does not operate or contact the pad. However, in an alternate embodiment of the invention the latch could be constructed to contact the stabilizer in either position.

Figure 11:
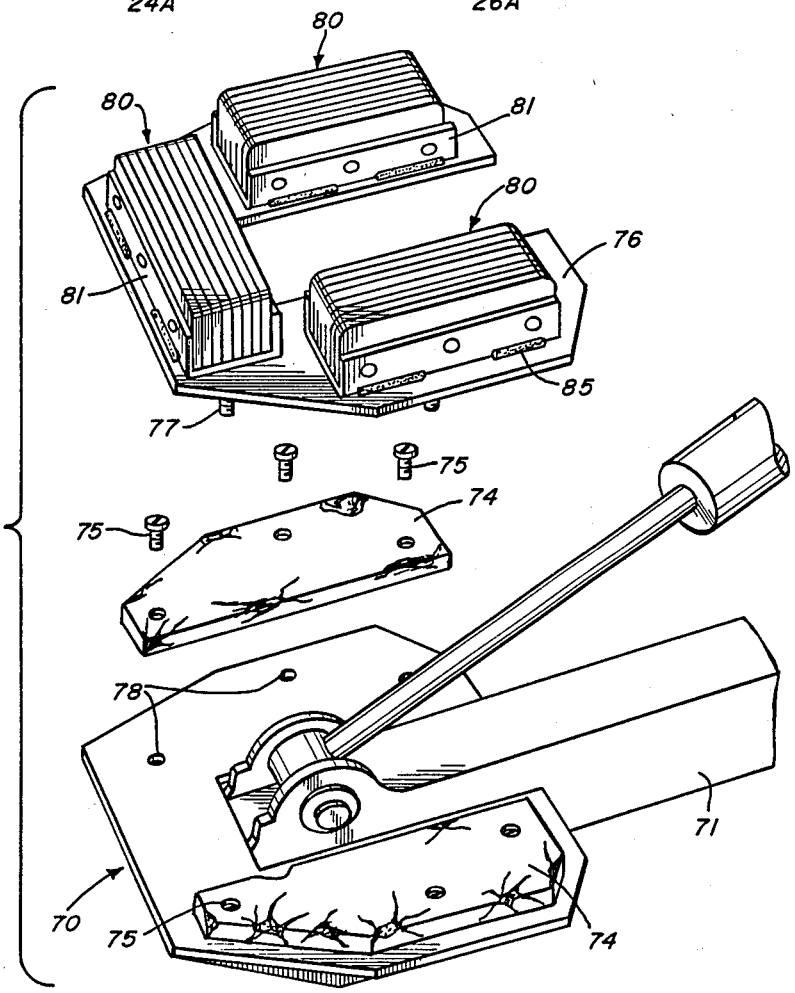
FIG. 11 is an exploded perspective view illustrating the further feature of the present invention of a pad support and adaptor plate used in applications of resilient pad replacement.
Figure 12:
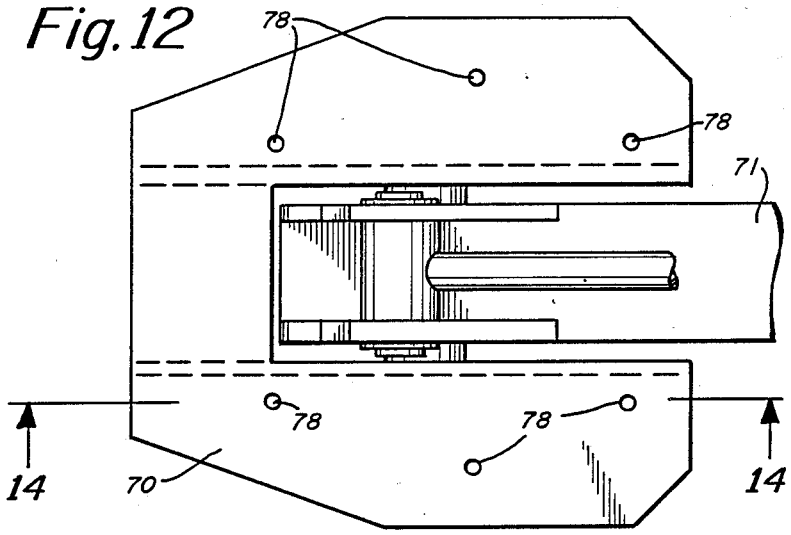
FIG. 12 is a top plan view of an existing stabilizer pad construction with the worn resilient pads removed.
Figure 13:
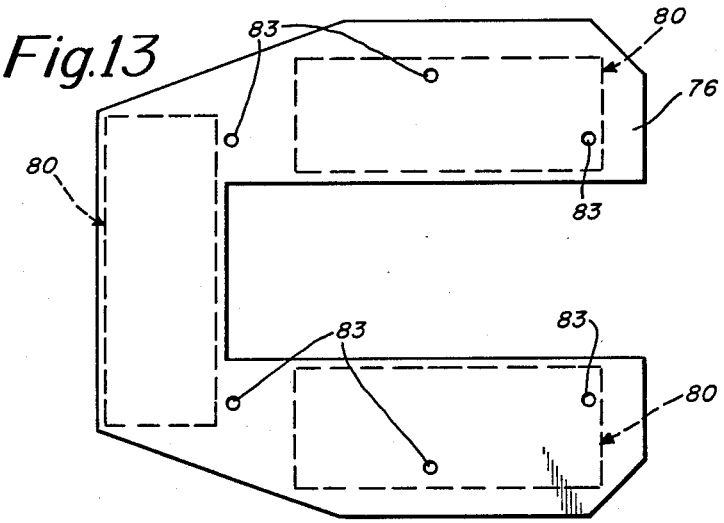
FIG. 13 is a bottom plan view of the adaptor plate as in accordance with the present invention.
Figure 14:
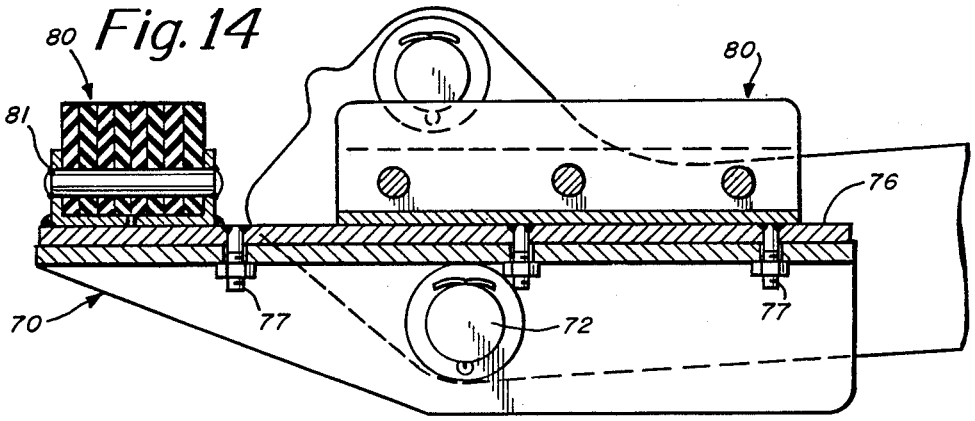
FIG. 14 is a cross-sectional view taken through the completed assembly with the pad and support adaptor plate having now been secured to the existing stabilizer pad plate.

A further feature of the present invention is illustrated in FIGS. 11–14. This feature pertains to a replacement pad concept particularly a it relates to the replacement of the resilient pads associated with the reversible stabilizer pad construction of earlier design and with different bolt hold patterns. FIG. 11 illustrates a reversible stabilizer pad 70 supported from a support arm 71 and pivoted by means of pivot pin 72 as illustrated in FIG. 14. FIG. 11 illustrates the original worn pads 74 that are each of essential by single piece rubber construction. FIG. 11 also illustrates the securing of bolts 75 associated with each of these pads. FIG. 1 illustrates the worn nature of the pads 74.

FIG. 11 also illustrates in accordance with the present invention the adapter plate 76 that is configured in shape to substantially match the configuration of the pad 70. A plurality of bolts 77 are welded to the adapter plate 76 and are disposed in a pattern matching the hole pattern at 78 of the pad 70. Furthermore, resilient pads 80 each in their angle iron holders 81 are welded to the top surface of the adapter plate 76.

FIG. 12 is a top plan view of the existing pad with the worn out resilient pads 74 removed. FIG. 13 is a bottom plan view of the adapter plate 76 illustrating the hole therein at 83 for accommodating the bolts 77 in a pattern matching the holes 78 in the pad 70. Finally, FIG. 14 is a cross-sectional view showing the replacement adapter plate with supported resilient pads bolted in position on the stabilizer pad plate.

In the construction of the resilient pads illustrated in, for example, FIG. 14, it is noted that the construction is of a laminate type including a securing pin for maintaining the laminates in proper position. It is also noted that the bolts 77 are preferably tack welded to the plate 76. After the welding of the bolts 77 in the proper bolt pattern, then the resilient pads with their holders 81 are tack welded as illustrated at 85 in FIG. 11.

Having now described a limited number of embodiments of the present invention, numerous other embodiments and modifications thereof should now be contemplated as falling within the scope of the present invention as defined by the appended claims.

What is claimed is:

1. For an earth moving apparatus having at least one support arm, a stabilizer comprising a plate-like piece having alternate surfaces one of which is resilient and the other of which includes a flanged web, means pivotably supporting said piece on end of said arm, said piece being rotatable relative to said support means between alternate positions wherein either said resilient surface is facing downwardly or said flanged web is engaging the ground, and latch means including a freely rotatable latch member adapted to operate under gravitational force to engage and lock said piece in a predetermined position when the support arm is down and to disengage from said piece when the support arm is lifted so as to enable manual pad reversal.

2. An apparatus as set forth in claim 1 wherein said latch means also includes means supporting said latch member from said support arm.

3. An apparatus as set forth in claim 2 wherein said latch member includes a shaft for support of an engaging latch piece that is adapted to contact the pad.

4. An apparatus as set forth in claim 3 wherein the latch piece is maintained in a vertical position throughout the lifting of the arm but rotates relative to the arm to permit disengagement from the pad as the arm is lifted.

* * * * *